US006357776B1

(12) United States Patent
Goertzen et al.

(10) Patent No.: US 6,357,776 B1
(45) **Date of Patent: *Mar. 19, 2002**

(54) CONSTANT CENTER OF GRAVITY TILTABLE CHAIR OF A WHEELCHAIR

(75) Inventors: Gerold G Goertzen, Brunswick, OH (US); Adrian J. Setacci, North York (CA); George Cockram, N. Ridgeville, OH (US); Todd M. Dinner, Elyria, OH (US); Hymie Pogir, Orange Village, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/164,068

(22) Filed: Sep. 30, 1998

Related U.S. Application Data

(63) Continuation-in-part of application No. 08/942,652, filed on Oct. 2, 1997, now Pat. No. 5,971,482.

(51) Int. Cl.[7] ..... A61G 5/00

(52) U.S. Cl. ..... 280/304.1; 280/250.1; 297/DIG. 4; 297/322; 297/329; 180/907

(58) Field of Search ..... 280/250.1, 304.1, 280/648; 297/DIG. 4, 317, 318, 322, 329; 180/907

(56) References Cited

U.S. PATENT DOCUMENTS

| | | | | |
|---|---|---|---|---|
| 2,270,172 A | | 1/1942 | Ruegger | |
| 3,758,151 A | | 9/1973 | Re | |
| 3,845,945 A | | 11/1974 | Lawley et al. | |
| 3,964,786 A | * | 6/1976 | Mashuda | 280/250.1 X |
| 4,544,200 A | * | 10/1985 | Dunn et al. | 297/DIG. 4 |
| 4,759,561 A | | 7/1988 | Janssen | |
| 4,872,903 A | | 10/1989 | Periou | |
| 4,944,555 A | | 7/1990 | Brusasco | |
| 4,966,379 A | * | 10/1990 | Mulholland | 280/250.1 X |
| 5,044,647 A | | 9/1991 | Patterson | |

(List continued on next page.)

FOREIGN PATENT DOCUMENTS

| | | | | |
|---|---|---|---|---|
| AU | 102285 | | 10/1937 | |
| EP | 841051 A2 | * | 5/1998 | 280/304.1 |
| FR | 1363420 | | 5/1964 | |
| FR | 2632504 | | 12/1989 | |
| GB | 1452940 | * | 10/1976 | 297/330 |
| GB | 2103475 | | 2/1983 | |
| GB | 2158350 | | 11/1985 | |
| JP | 0085730 | | 5/1983 | |
| WO | 92/08636 | * | 5/1992 | 280/250.1 |

OTHER PUBLICATIONS

P. 19 of the Summer 1997 Rehab Extra of an advertisement for "The Tiltmaster–C.G." (by Mechanical Application Designs, Inc.).from Health Care Inc. Exeter, Pa., published by Miramar communications, Inc., Malibu, CA.

*Primary Examiner*—J. J. Swann
*Assistant Examiner*—F. Zeender
(74) *Attorney, Agent, or Firm*—Hudak & Shunk Co., L.P.A.

(57) ABSTRACT

A wheelchair has a constant center of gravity tilt assembly which can be connected to any type of frame structure. A chair is pivotally attached to the tilt assembly which includes a slidable guide member. The guide member is slidably attached to a guide rail which can be mounted on the frame. An actuator for moving the chair forward and backward is operatively connected at one end to the slidable guide member and at the other end to the wheelchair frame. A link arm has one end operatively connected to said frame and the other end pivotally connected to the seat of the integral chair. Upon actuation of the actuator, said guide member moves said chair forward or backwards and as a consequence thereof, said seat is tilted backward or forward by said link arm to substantially maintain the center of gravity of a person seated in the chair.

34 Claims, 8 Drawing Sheets

U.S. PATENT DOCUMENTS 5,050,899 A * 9/1991 Stensby ..... 280/250.1
5,181,762 A 1/1993 Beumer
5,222,402 A 6/1993 White et al.
5,297,021 A 3/1994 Koerlin et al.
5,333,887 A * 8/1994 Luther ..... 280/250.1
5,556,121 A * 9/1996 Pillot ..... 280/304.1
5,593,173 A * 1/1997 Williamson ..... 280/250.1
5,772,226 A * 6/1998 Bobichon ..... 280/250.1
6,032,976 A 3/2000 Dickie et al.

* cited by examiner

CONSTANT CENTER OF GRAVITY TILTABLE CHAIR OF A WHEELCHAIR

CROSS REFERENCE

The present application is a continuation-in-part application of U.S. patent application Ser. No. 08/942,652, filed Oct. 2, 1997, now U.S. Pat. No. 5,971,482, for "A Constant Center of Gravity Tiltable Chair of a Wheelchair."

FIELD OF INVENTION

The present invention relates to a wheelchair wherein the center of gravity of a person seated on an integral chair is substantially maintained when the chair tilts. The tiltable chair is operatively and slidably mounted on generally any type of frame structure.

BACKGROUND OF THE INVENTION

Heretofore, chairs per se or wheelchairs have existed wherein the chair back, or the chair back and base (seat), were reclinable.

For example, U.S. Pat. No. 3,758,151 to Re relates to a reclining chair adapted to be positioned in close adjacency to a room wall when in the upright sitting position and yet so structured as to allow ready assumption of any of a variety of reclined positions of occupancy without physical contact of any element thereof with the same room wall, the chair concept envisioning a fixed platform, a chassis movable linearly relative to the platform, and a body-supporting unit movable between the sitting and reclining positions relative to the chassis with a concomitant movement of a leg supporting unit between the retracted and extended positions respectively, a propeller link or other means connecting between the body-supporting unit and platform for propelling the body-supporting unit relative to the platform, with the chassis moving forwardly and progressively away from the wall as transition is made from upright sitting position to progressive positions of reclination, wherefore the body supporting unit is concomitantly moved forwardly away from the room wall, and with the chassis moving rearwardly and progressively toward the wall as transition is made from positions of reclination to upright sitting position, wherefore the body-supporting unit is concomitantly moved rearwardly and toward the room wall.

U.S. Pat. No. 4,759,561 to Janssen relates to a wheelchair comprising an underframe with front and rear wheels, and a seat part (1) which is adjustable relative to the underframe, which seat part (1) can be tilted forward and backward relative to the underframe in such a way that the overall center of gravity (6) of seat part (1) and wheelchair user (5) essentially assumes a fixed position relative to the underframe.

U.S. Pat. No. 4,966,379 to Mulholland relates to a wheelchair having opposing sideframes each of which comprise a base section which is pivotally connected by a brace member to an inclinable seat section. An extender mechanism interconnects the seat section to a brace member and provides releasable securement for a wheelchair seat at selected angular positions. Backrest bars are independently adjustable with a similar extender mechanism that interconnects the bars with a respective seat section. The sideframes are spaced apart with hinged spacer bars, which includes a latching device for releasably securing the bars in an open position. The bar and frame sections have elongated slots containing fasteners for adjustable connections with fasteners from adjunct wheelchair assemblies.

U.S. Pat. No. 5,044,647 to Patterson relates to a kit or assembly which can be used in the manufacture of a new wheelchair or to retrofit an existing wheelchair. The basic wheelchair structure includes a base portion having a pair of cross members mounted in the rear half of the upper portion of the wheelchair base structure. A pair of parallel guide rails is mounted between the cross members with a seat support bar attached to a pair of pillow blocks mounted on the guide rails. A linear actuator is centrally positioned within the wheelchair base structure to longitudinally move the seat support bar forwardly or rearwardly within the wheelbase of the wheelchair. A rear edge of a wheelchair seat unit is pivotally attached to the upper surface of the seat support bar. Cam plates, each having a curved cam slot, are provided on each side of the seat unit with the cam slots engaging cam followers mounted on a pair of stanchions provided on each side of the rear portion of the base structure. A control switch causes the linear actuator to move the seat support bar in a forward or rearward direction, which causes the seat unit to move causing the cam follower pins positioned within the cam slots to tilt or angularly move the seat unit to a maximum reclined position of approximately 60 degrees. The entire seat unit is moved forward a predetermined distance to obtain the desired degree of tilt and to maintain the center of gravity substantially centered within the base structure to maintain the balance and stability of the wheelchair and the safety of the patient.

U.S. Pat. No. 5,297,021 to Koerlin et al. relates to a wheelchair seat having a backrest assembly with a counter balance to provide equilibrium. A control loop is included on the sliding backrest to sense the onset of shear and compensate the backrest to a zero shear position during recline. A leg rest assembly has a selectable lift arrangement for either independent or recline lift.

SUMMARY OF INVENTION

The present invention relates to a tiltable chair having a constant center of gravity tilt assembly. The chair contains a pivot point at generally the junction of the chair seat and chair back which junction is connected to the tilt assembly comprising a longitudinal guide member slidable along a substantially horizontal and linear guide rail. An actuator, which causes the chair to move either forward or backward, is operatively connected to the wheelchair frame structure and to the slidable guide member. As the chair moves forward, a link arm, which is operatively connected to the frame structure at one end and to a chair seat pivot point at the other end, causes the chair to rotate or tilt backward. Desirably, the link arm is approximately the same length as the distance from the seat pivot point to the chair pivot point. The rearward tilt of the center of gravity of a person seated in the chair is such that it is substantially equal to the forward movement of the chair so that said center of gravity of a seated person is substantially maintained. The chair can be tilted either manually or by the utilization of an actuator.

BRIEF DESCRIPTION OF THE DRAWINGS

FIG. 3 is a top plan view taken on line 4:4 of FIG. 1 showing the wheelchair frame assembly, actuator, and the like;

FIG. 9 is a perspective view showing the guide member, the rail, the actuator, the offset cross frame and bracket, and the like;

DETAILED DESCRIPTION OF THE PREFERRED EMBODIMENT

According to the present invention, a standard or conventional wheelchair, such as a front, mid, or rear wheel drive wheelchair containing a stable, tiltable chair, can be manually operated or powered by a source of energy such as a battery. The wheelchair furthermore can contain a rear wheel axle directly mounted to a frame or utilize a suspension mount.

Figure 1:
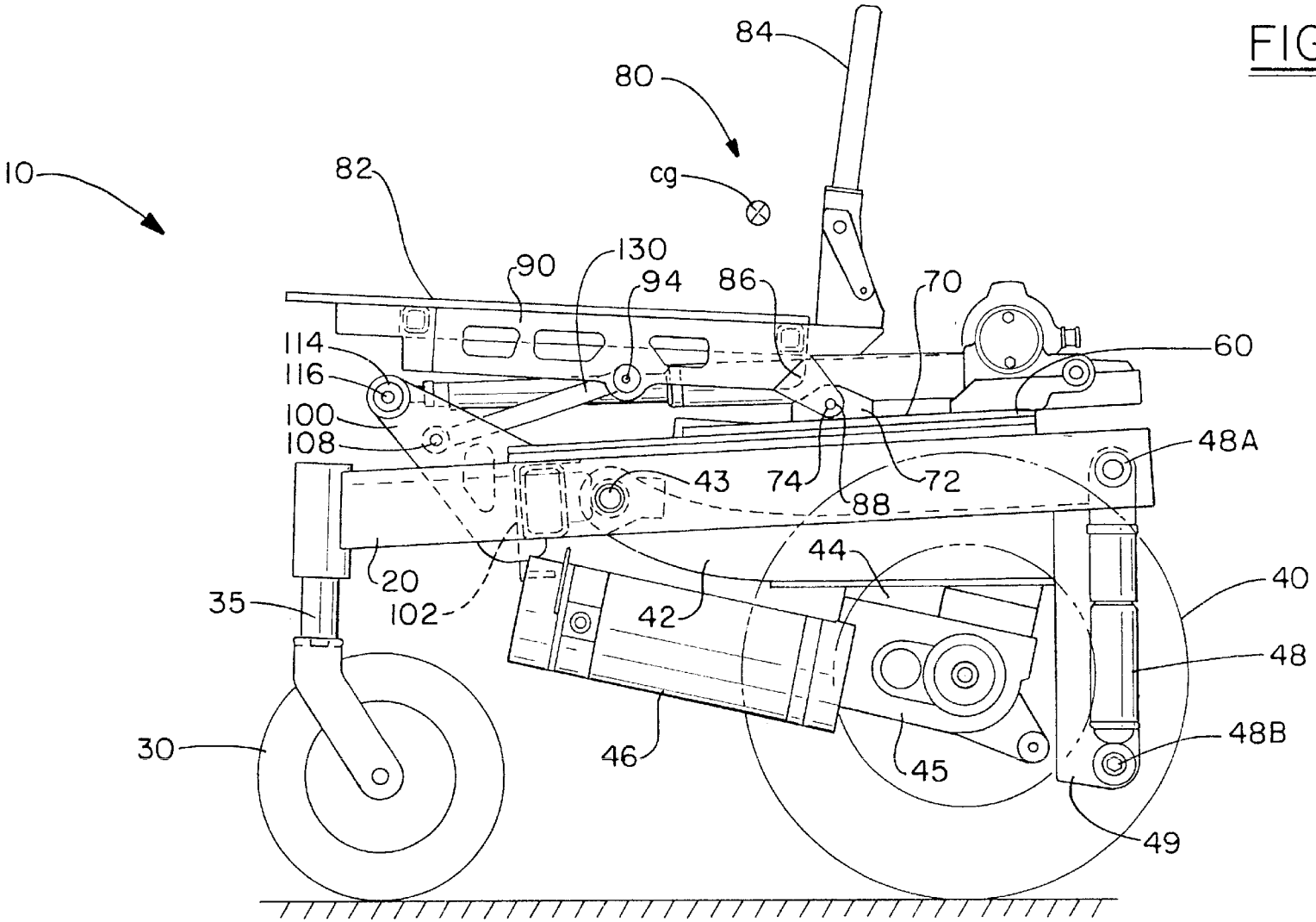
FIG. 1 is a side elevational view of a wheel chair of the present invention showing the chair in an upright position.
Figure 2:
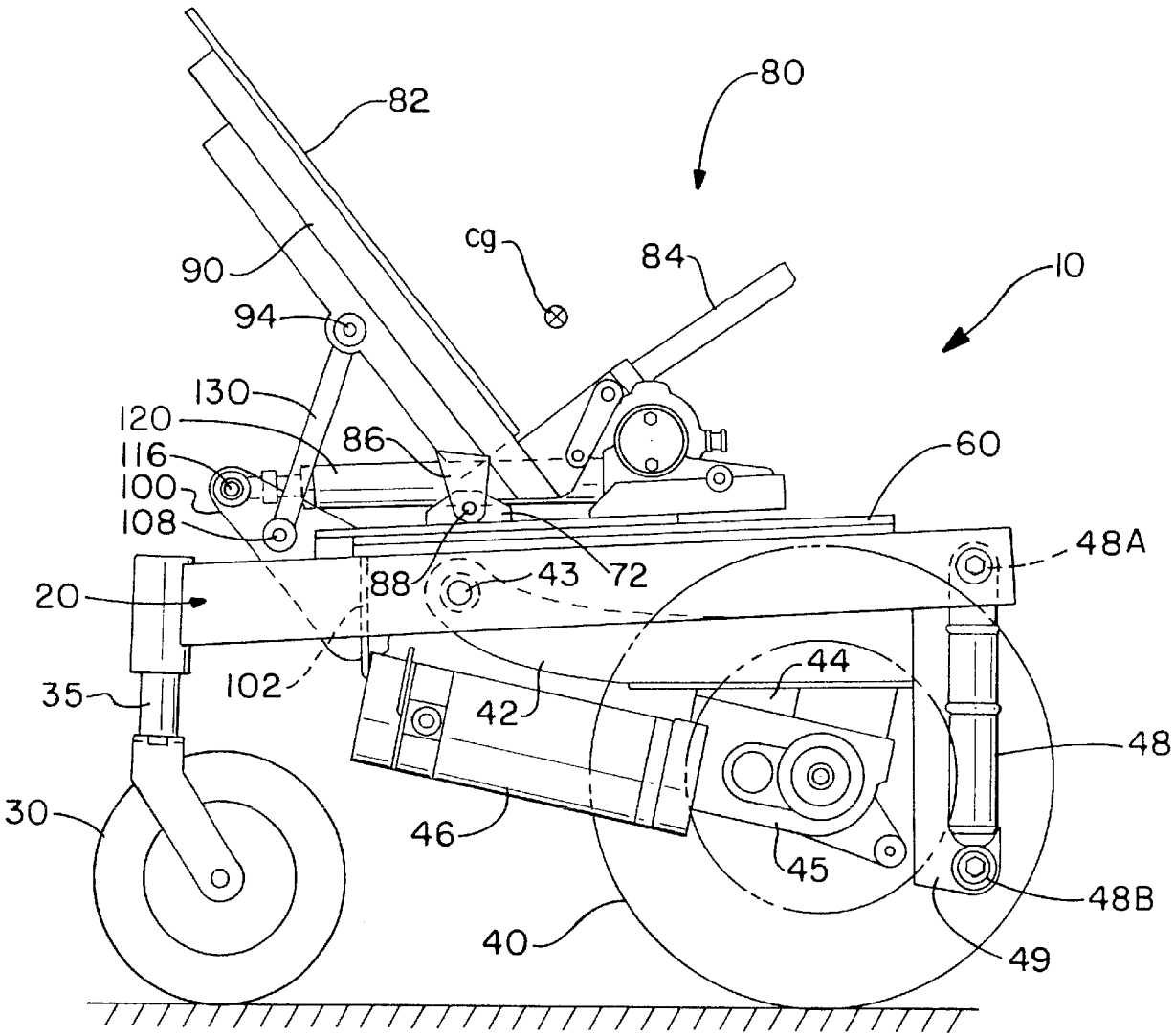
FIG. 2 is a side elevational view showing the chair tilted substantially backwards.

Referring to the drawings and particularly to FIGS. 1 and 2, the wheelchair, generally indicated by the number 10, comprises frame 20 and front and rear wheels. Front wheel 30, which can be solid or pneumatic, is mounted to the front portion of frame 20 by caster assembly 35. This arrangement allows the front wheel to freely rotate during use of the wheelchair so that it has a short turning radius. Rear wheel 40 is attached to the frame via swing arm 42. The front end of the swing arm is pivotably attached as through pin 43 to the frame. The back end of the swing arm can be attached to wedge 44 which in turn is connected to gearbox 45. Gearbox 45 is connected to rear wheel 40 and is operated by motor 46. To dampen bumps or uneven surfaces encountered by rear wheel 40, shock absorber 48, which may or may not contain a compression spring, is connected at one end 48A to frame 20 and at the other end 48B to swing arm suspension bracket 49.

A constant center of gravity tilt assembly contains rail 60 residing on the top surface of frame 20 and extends a substantial length of the frame such as at least 40 or 50 percent thereof. Rail 60 is linear and inasmuch as it is attached to the frame, extends in generally a horizontal direction. The rail can generally have any cross-sectional shape such as an "X" having grooves or indentations along each side thereof. Longitudinal guide member 70 slidably engages rail 60 and can extend along a significant length thereof, for example, at least 30 percent, and desirably at least 40, 50 or 60 percent. The slidable engagement between guide member 70 and rail 60 can be accomplished by a number of means such as lubrication, low friction guide surfaces, etc., with ball bearings being preferred. Desirably, a vertically extending bracket 72 having an aperture 74 therein is attached at approximately the center portion of guide member 70.

Chair 80 contains an integral seat 82 and back 84. Chair pivot bracket 86 is connected to the chair generally in the vicinity of the junction of the back and seat portions such as directly below the back. Chair pivot bracket 86 contains aperture 87 therein. Although chair 80 can be movably or slidably attached directly to frame 20 or rail 60 as through slots, not shown, it is desirably attached to guide member 70. For example, through pivot pin 88, chair 80 is pivotally attached to longitudinal guide member bracket 72 so that the chair can tilt backwards any desired degree.

Figure 4:
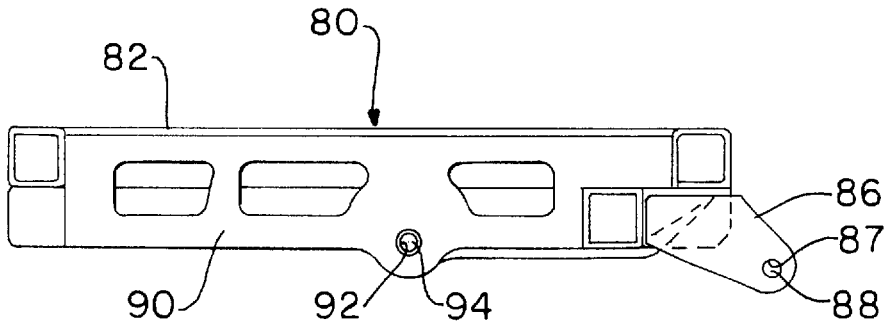
FIG. 4 is a side elevational view showing chair seat frame.

Chair seat 82 is connected to chair seat frame 90. As best shown in FIG. 4, generally the center portion of the seat frame longitudinal length has a pivot aperture 92 to receive a pin 94 therein. Pivot pin 94 serves to rotatably or pivotally engage chair seat frame 90 and link arm 130.

Figure 3:
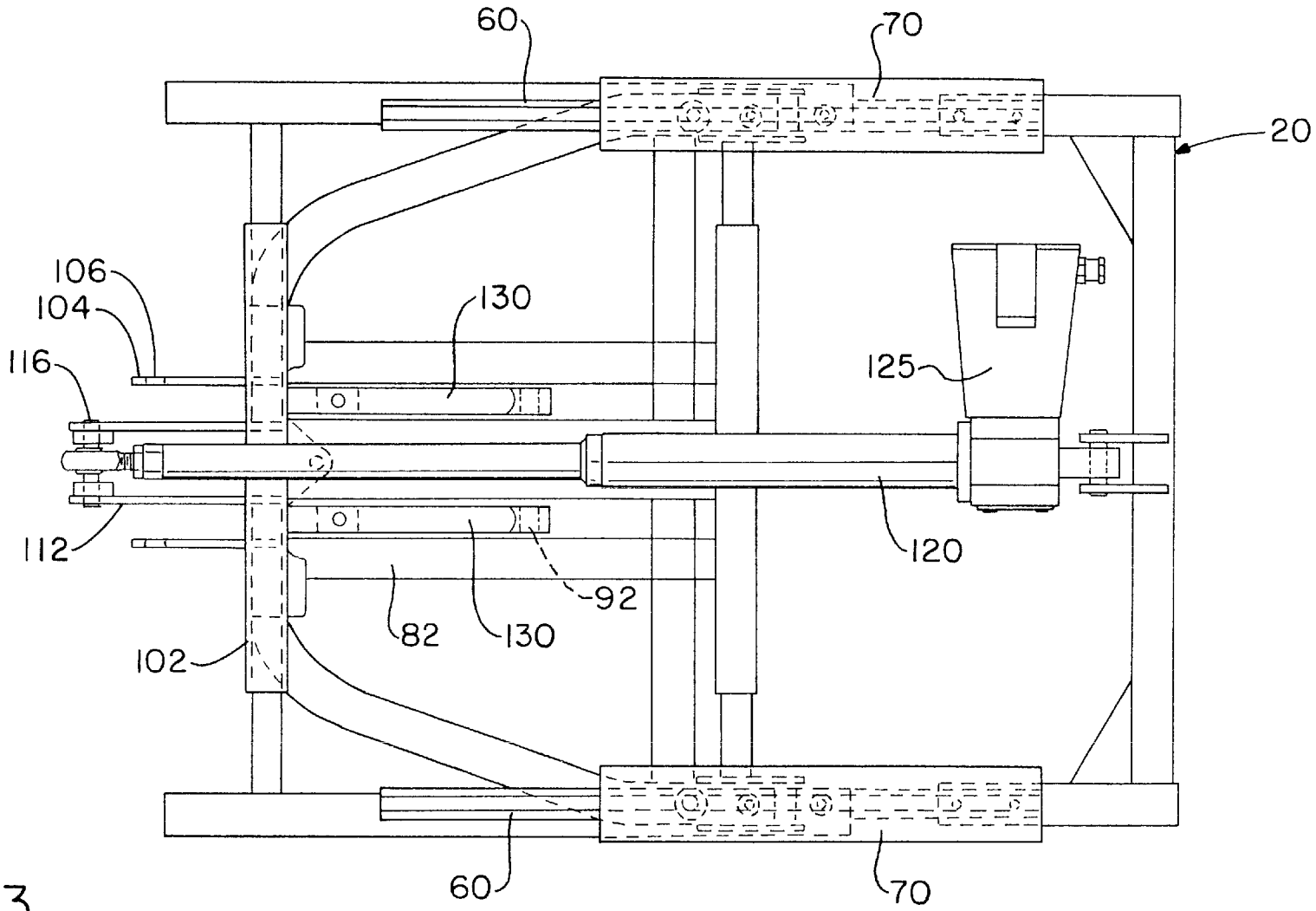

Referring to FIGS. 1, 2, and 3, cross frame bracket 100 is attached to cross frame 102. The cross frame bracket extends forward from the cross frame and has a plurality of linking members and lateral arms extending therefrom. More specifically, lateral bracket-linking members 104 each have an aperture 106 therein to receive pin 108. Pin 108 serves to pivotally attach link arm 130 to bracket 100. Cross frame bracket 100 also contains a pair of lateral arms 112 which extend forward from the cross frame with each arm having an aperture 114 therein for receiving pin 116. Pin 116 serves to connect actuator 120 with cross frame bracket 100.

Actuator 120 as noted, at its forward end, is connected to the cross frame bracket 100 via lateral arms 112 and pin 116. The other or backward end of actuator 120 can be directly attached to chair 80 such as through chair pivot bracket 86 (not shown). However, chair 80 is desirably attached to longitudinal guide member 70 in any conventional manner and desirably at a different location than the chair attachment to the guide member. As noted above, guide member bracket 72 is fixedly secured to slidable longitudinal guide member 70. Thus, as actuator 120 is retracted, it moves guide member 70 forward, which because it is fixedly secured to guide member bracket 72, moves chair 80 forward through chair bracket 86.

Actuator 120 can be any mechanical device, which reciprocates backwards and forward and desirably is driven by electric motor 125. While a hydraulic system may be utilized, an actuator is desired with a ball screw linear actuator being preferred.

As shown in the drawings such as FIGS. 2 and 3, link arm 130 is connected at one end to cross frame bracket lateral members 104 and at the other end to any portion of integral chair 80 and preferably to the center portion of chair seat frame 90. It is a desirable aspect of the present invention that the link arm length, i.e., the distance from seat frame pivot pin 94 to cross frame bracket link pin 108 is substantially equal to the distance from seat pivot pin 94 to chair pivot pin 88. That is, these two distances or lengths generally contain less than a 30 percent difference, desirably less than a 20 percent difference, and preferably less than a 15 percent, 10 percent, and even a 5 percent difference based upon the length of the longer distance. Moreover, as shown, link arm 130 from pivot point 94 is inclined downwardly from about 15 to about 35 degrees whereas a line from pivot point 94 to chair pivot pin 88 is almost horizontal or slightly inclined downwardly as from about 2 to about 8 degrees. These aspects generally provide for maintaining the center of gravity, i.e., "cg," of a person seated within the tiltable chair as more fully described herein below.

The operation of the tiltable chair of the present invention is as follows. Upon actuation of a switch as by a person confined to a wheelchair, motor 125 is activated and actuator 120, e.g., a ball screw linear actuator, is retracted. Because the linear actuator is fixedly attached to cross frame bracket 100, the rear portion (e.g., casing) of the linear actuator is drawn forward. Since the actuator casing is fixedly attached to longitudinal guide member 70, it causes the guide member to slidably move forward over rail 60. Inasmuch as chair pivot bracket 86 is also fixedly attached to longitudinal guide member 70, the chair is also moved forward. As a consequence thereof, link arm 130 pivots about pin 108 and causes seat 82 to be raised in a rearward tiltable manner as shown in FIG. 2. The tilting of the chair causes the center of gravity (cg) of an individual seated on the chair to be moved tiltingly backwards. Since the length of link arm 130 is approximately equal to the distance between seat frame pivot pin 94 and chair pivot pin 88, the distance chair pivot pin 88 is moved forward is substantially equal to the distance chair back 84 tilts backwards at a particular height of the back which generally coincides with the center of gravity of a person seated on the chair. The center of gravity of a person is typically located on a vertical line slightly, e.g., about ½ to about 3 inches, behind their navel. The net result is that while the "cg" of the seated person is moved backwards by the tilting of the wheelchair, the forward movement of the chair as a whole results in substantially maintaining the center of gravity, i.e., the physical longitudinal movement, of the person at the same position or location on the wheelchair. That is, the forward or backward longitudinal movement of the "cg" is less than 20 percent, desirably less than 15 or 12.5 percent, and preferably less than 10 percent, 7.5 percent, 5 percent or 2.5 percent of the total longitudinal distance of wheelchair frame 20. This provision of maintaining the center of gravity (longitudinally) maintains stability of the wheelchair and yet permits a person seated thereon to be tilted backwards. The tilt or rotation of the wheelchair can be to any desired degree. For example, if the initial wheelchair seat is horizontal, it can be tilted rearwardly over a range of approximately 45 degrees and thus to an angle of about 45 degrees from the horizontal. Should the wheelchair seat, however, be at an initial slight inclination to the horizontal, for example, 5 degrees, the tilt thereof through a 45 degree angle will move the seat backward to an angle of from 50 degrees from the horizontal. Generally any desired degree of tilt or rotation can be built in to the wheelchair assembly of the present invention.

Upon reversal of the linear actuator, the seat can be returned to its generally substantial horizontal position.

Figure 5A:
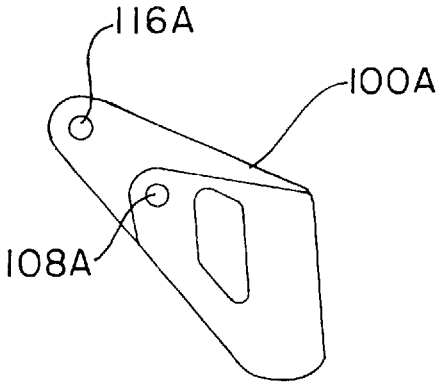
FIGS. 5A and 5B are side elevational views showing a cross frame bracket generally proportionally identical to but smaller than the brackets shown in FIGS. 1, and 2.
Figure 5B:
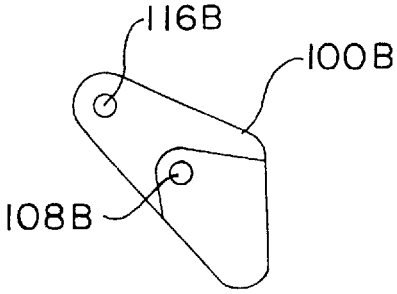

To maintain the stability of the tiltable chair of the wheelchair of the present invention when the same is utilized by a large person or a small person, different size brackets are utilized such as shown in FIGS. 5A and 5B. These brackets are generally identical to the brackets shown in FIGS. 1 and 2, except that bracket 5A is larger, and bracket 5B is smaller than bracket 100. In other words, the forward projection or distance of bracket pivot link 108A is longer than that in FIGS. 1 and 2. The forward projection of distance of bracket link pivot pin 108B to cross frame 102 as shown in FIG. 5B is shorter than in FIGS. 1 and 2. The net result is when an appropriate longer bracket 5A is utilized for a small person, chair 80 is moved to a more forward location than that shown in FIGS. 1, and 2. Conversely, when a shorter bracket 5B is utilized for a large person, chair 80 is moved to a more rearward or backward location than that shown in FIGS. 1 and 2. In either event, the center of gravity of a large person (more forward than a normal person) or a short person (more rearward than a normal person) when using an appropriately sized bracket will generally be at about the same location as that of a normal sized person as in the embodiment of FIGS. 1 and 2. Thus, the stability of the tiltable chair is maintained.

Figure 6:
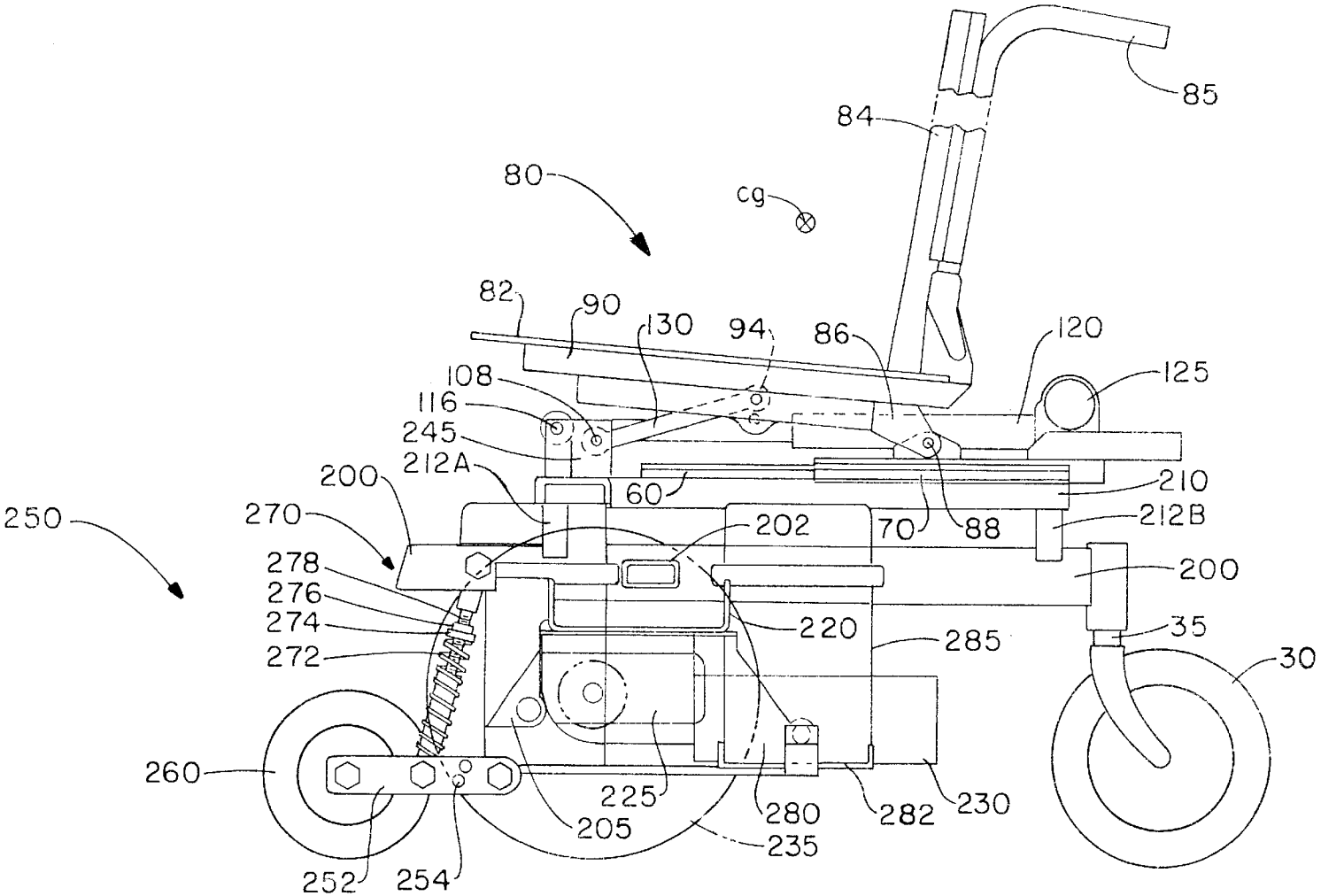
FIG. 6 is a side elevational view of another wheelchair embodiment of the wheelchair in accordance with the present invention and contains an offset frame having a guide rail mounted thereon.

Referring to FIG. 6, a wheelchair similar to the embodiments of FIGS. 1–5 is shown, especially with regard to the tilt assembly structure to maintain the center of gravity of an individual seated within the chair as the chair is tilted rearwardly. For example, guide rail 60, guide member 70, tiltable chair 80 having integral seat portion 82 and back portion 84, chair pivot bracket 86, link arm 130 which is pivotally connected to the chair seat at a pivot point such as chair seat pivot pin 94, and the like, are similar if not identical to FIGS. 1–5. By the term "integral" it is meant that the chair seat 82 and chair back 84 tilt together and thus the seat and back can be made from a continuous component, or from a plurality of components such as two components welded, bolted, or screwed together, or the like. It is also noted that pivot pin 94 can be located closer to the chair seat 82 than in the embodiments of FIGS. 1–5 for purposes of compactness. The length of link arm 130 is such that it will maintain the center of gravity of a person seated in chair 80 in both a 0 degree position and a 45 degree tilt position at generally the same longitudinal location. For example, as shown in FIGS. 1–5, the distance of link arm 130 between pivot pin 108 and seat pivot pin 94 (located forwardly of chair bracket 86) is substantially the same as the distance between the pivot pin 94 and the chair pivot bracket pin 88. Also, the same actuator 120 can be utilized as shown in the embodiments of FIGS. 1–5 wherein chair 80 is desirably attached in any conventional manner to longitudinal guide member 70 on frame 20 or to a bracket thereon with the actuator being operated by motor 125. Since the same elements, structural features, method of operation, and the like are utilized as set forth in the embodiment of FIGS. 1–5, the same is hereby fully incorporated herein rather than being repeated.

As best seen in FIGS. 6–10, rather than being mounted directly on main frame 200, guide rail 60 is mounted on offset frame 210, which is connected through front leg 212A and rear leg 212B to the mainframe of the wheelchair. The utilization of an offset frame provides for longitudinal stability of different sized individuals as explained herein below. In the embodiments of FIGS. 6–10, mainframe 200 contains a large generally U-shaped bracket 220 connected thereto with the bracket containing a plurality of apertures 222. This allows for gear box 225 to be connected to the bracket as through nuts and bolts at a plurality of different locations so that the location of drive wheel 235 and accordingly the center of gravity of the wheelchair can be varied either forward or backward. Gear box 225 can be any desirable type of gear box but preferably is a variable one speed gear box and is driven by electric motor 230. Inasmuch as drive wheel motor 230 and gear box 225 are connected to one another with the gear box in turn being directly connected to gear box bracket 220 which is directly mounted to main frame 200, there is no suspension between drive wheel 235 and the wheelchair frame. However, a suspension system can be utilized such as the type shown in FIGS. 1 and 2.

Alternatively, generally any type of frame structure can be utilized with the constant center of gravity tilt assembly or structure of the present invention. Thus, the frame structure of FIGS. 1–10 constitutes only a few constructions of the numerous frame structures which can be employed.

Anti-tipping wheel assembly 250 is contained in a mid wheel drive wheelchair in the embodiment of FIGS. 6 through 9 to provide further stability to the wheelchair upon fast stops or deceleration. As best seen in FIG. 6, at one end link arm 252 is connected by a fastening means such as a bolt or screw through an aperture to the bottom of main frame frontleg 205. The other end of the link arm is connected through a bolt or screw to front wheel 260. The link arm can contain a plurality of apertures 254, which through a fastening means such as a bolt or screw, can be connected to the bottom of stabilizer spring 270. Depending upon the aperture utilized, as well as the length of the stabilizing spring assembly, etc., the height of front wheel 260 above a surface can be varied. The top end of stabilizing spring 270 through an aperture containing a bolt or screw is secured to main frame 200. Stabilizing spring assembly 270 can be a variety of mechanisms, but generally contains a spring 272 extending along a portion of the assembly and having at one end a washer 274 and nut 276 which can be rotated about a threaded shaft 278 to increase or decrease the pressure on the spring.

As best seen in FIG. 6, a battery bracket 280 can be attached to the gear box or to the main frame. Battery trays 282 are generally mounted laterally inside of motor 230 and gear box 225 for separately holding a plurality of batteries 285 such as two, which in the embodiment of FIGS. 6–10 are separated from one another by main cross frame 202. Battery 285 can generally be any conventional battery utilized in a power or electrically operated wheelchair. Alternatively, the wheelchair can be a manual wheelchair.

Figure 7:
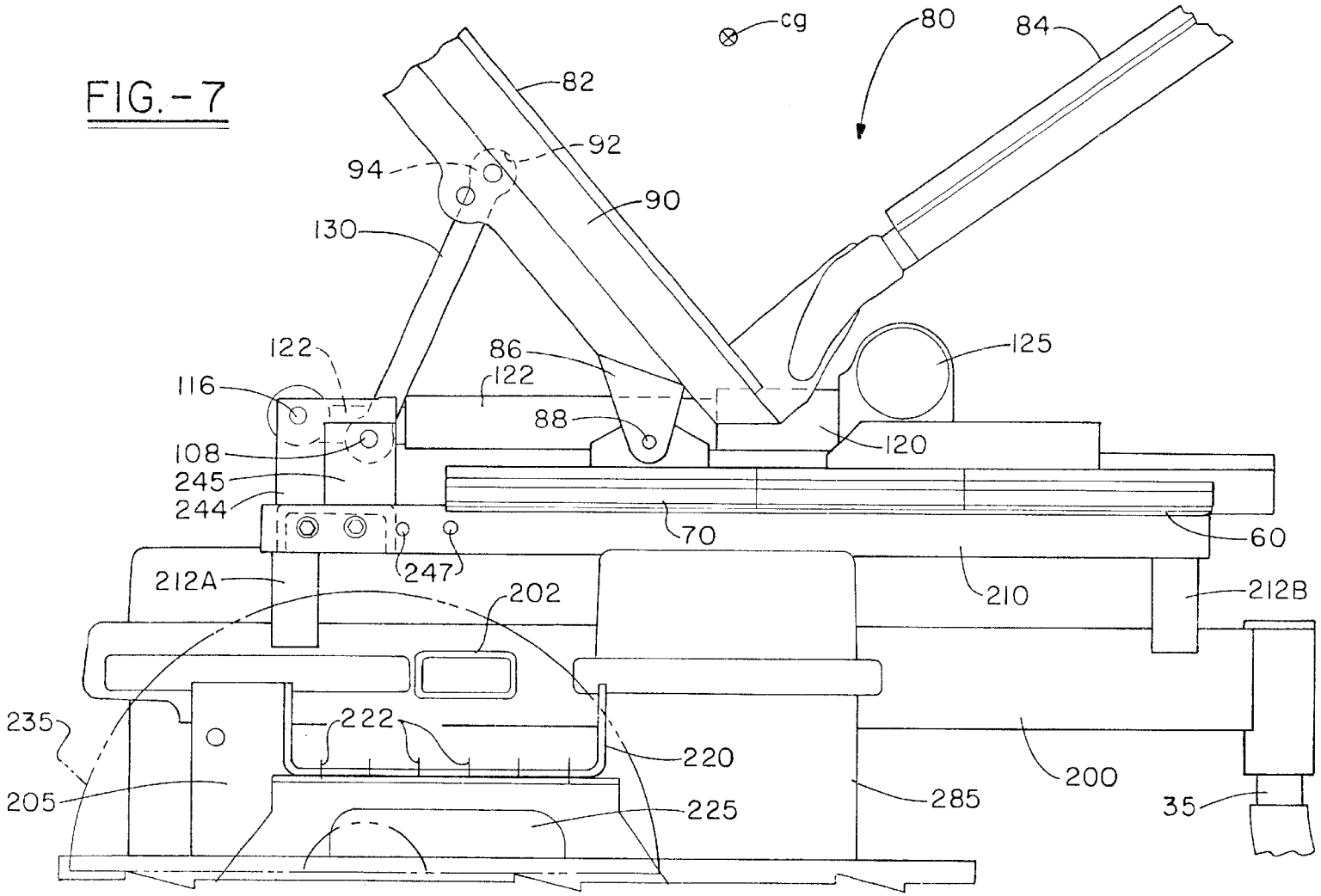
FIG. 7 is a partial side elevational view showing the upper portion of the wheelchair of FIG. 6 in a tilted position.
Figure 9:
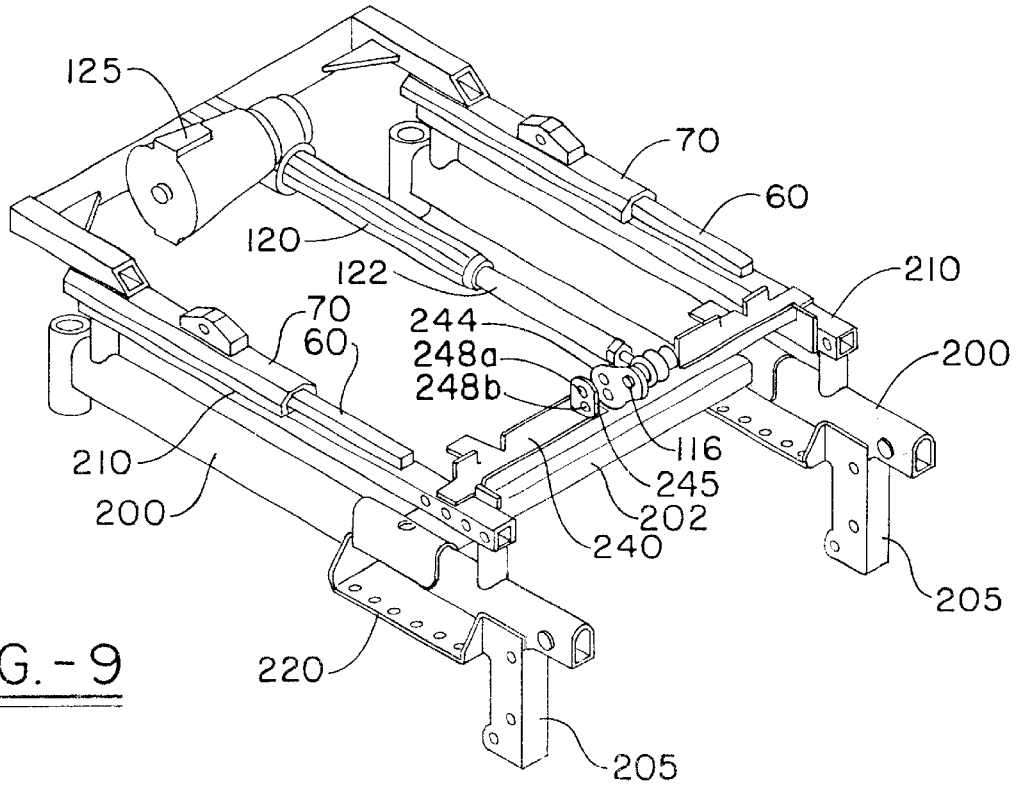

As apparent from FIG. 9, lateral frame members of offset frame 210 are connected to each other by cross frame member 240. As best seen in FIGS. 6, 7 and 9, offset cross frame bracket 244, which is connected to cross frame 240, has an aperture therein to relieve actuator pin 116 of actuator telescoping piston rod 122. Thus telescoping rod 122 is connected to offset cross frame 240. Upon contraction or extension of actuator rod 122, glide member 70 will be respectively moved forward or rearwardly. Link arm 130 can be connected via pin 108 to offset cross frame flange 245 containing aperture 248*b* when back portion 84 of the chair is in a vertical position, or to aperture 248*a* when chair back 84 of integral chair 80 is inclined rearwardly approximately 5 degrees. Of course, other angles can be utilized.

Figure 8:
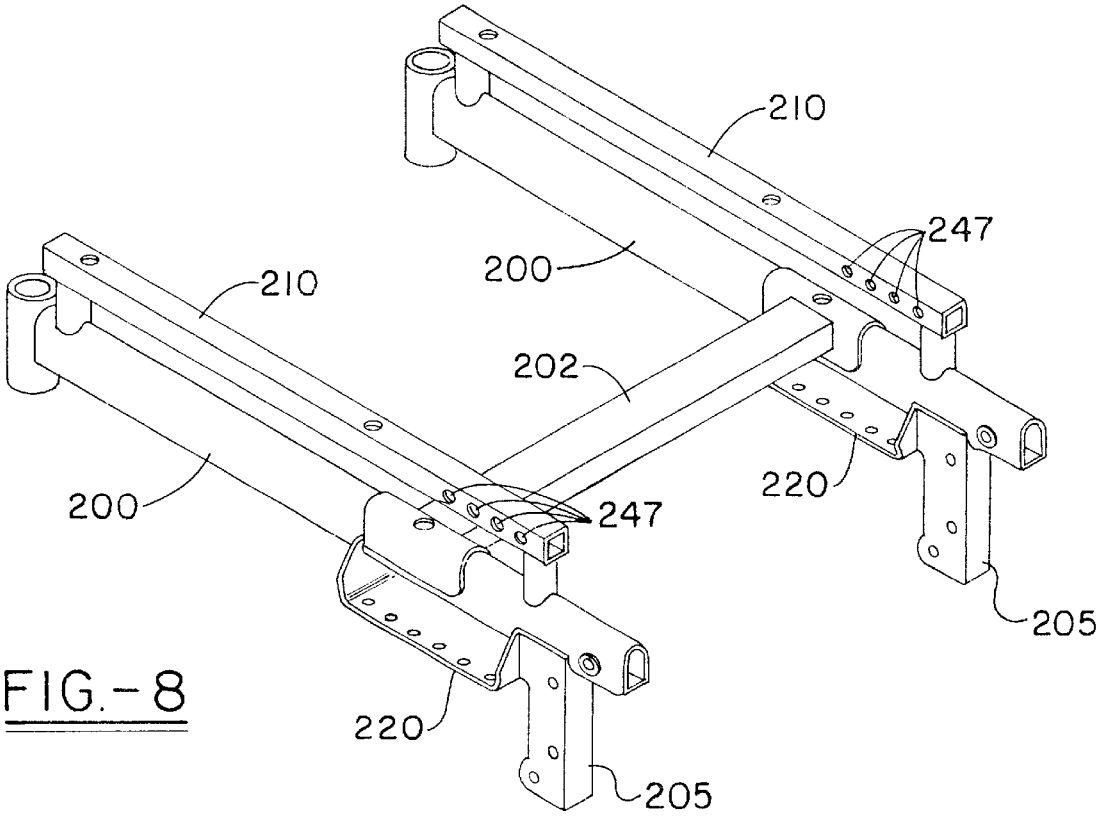
FIG. 8 is a perspective view of the offset frame embodiment of FIGS. 6 and 7.

In order to accommodate a heavy person who generally has a relatively forward center of gravity or a thin person who generally has a relatively rearward center of gravity as compared to a normal person, a plurality of bolt holes or apertures 247, see FIGS. 7 and 8, exist in offset frame 210 to allow a forward location, middle location, or rearward location of offset cross frame 240. Generally, when an average person utilizes the wheelchair of embodiments 6–10, the center two cross frame bolt apertures can be utilized. When a heavyset person utilizes the wheelchair, the rearward two apertures 247, are generally utilized. Conversely, when a thin person utilizes the wheelchair, the forward two apertures 247 are utilized so that the chair is moved to a forward position. As with the embodiments set forth in FIGS. 1–5, the stability of the tiltable chair of the wheelchair is improved. While only four apertures 247 are shown, it is to be understood that any number of apertures such as from 5 to about 10 can be utilized. Offset cross frame 240 is generally located from about 10 to about 40 percent forward of the cross frame of the embodiment of FIGS. 1–5 so that bracket 100, 100A and 100B can be eliminated. Instead, as noted above, a flange 245 is utilized which is directly mounted on the offset cross frame 240. Through the utilization of the structure beneath the chair seat and generally above the main frame or offset frame, such as the actuator, the slide rail, the guide member, pivot arm 130, and the like, the center of gravity of an individual is generally maintained as noted herein above, and generally is 15 or 10 percent or less, desirably 5 percent or less, and preferably 2.5 percent or less of the total longitudinal distance of wheelchair frame 200.

The operation of the tiltable chair of FIGS. 6–9 is essentially similar if not identical to that of FIGS. 1–5 as discussed herein above are thus herein fully incorporated by reference. For example, upon actuation of motor 125, actuator 120 is retracted, causing guide member 70 to slide forwardly over rail 60, which in turn causes link arm 130 to pivot about pin 108 thereby raising the seat and tilting the same backwards. Due to the geometric construction of the assembly, such as the link arm distance being essentially the same as the distance from the seat pivot bracket pin or point 94 to the chair pivot bracket point or pin 88, the center of gravity of a person seated thereon is generally maintained, at least with respect to a longitudinal direction. Upon reversal of motor 125, the operation is reversed and the tilted chair is brought to an upright position.

Figure 10:
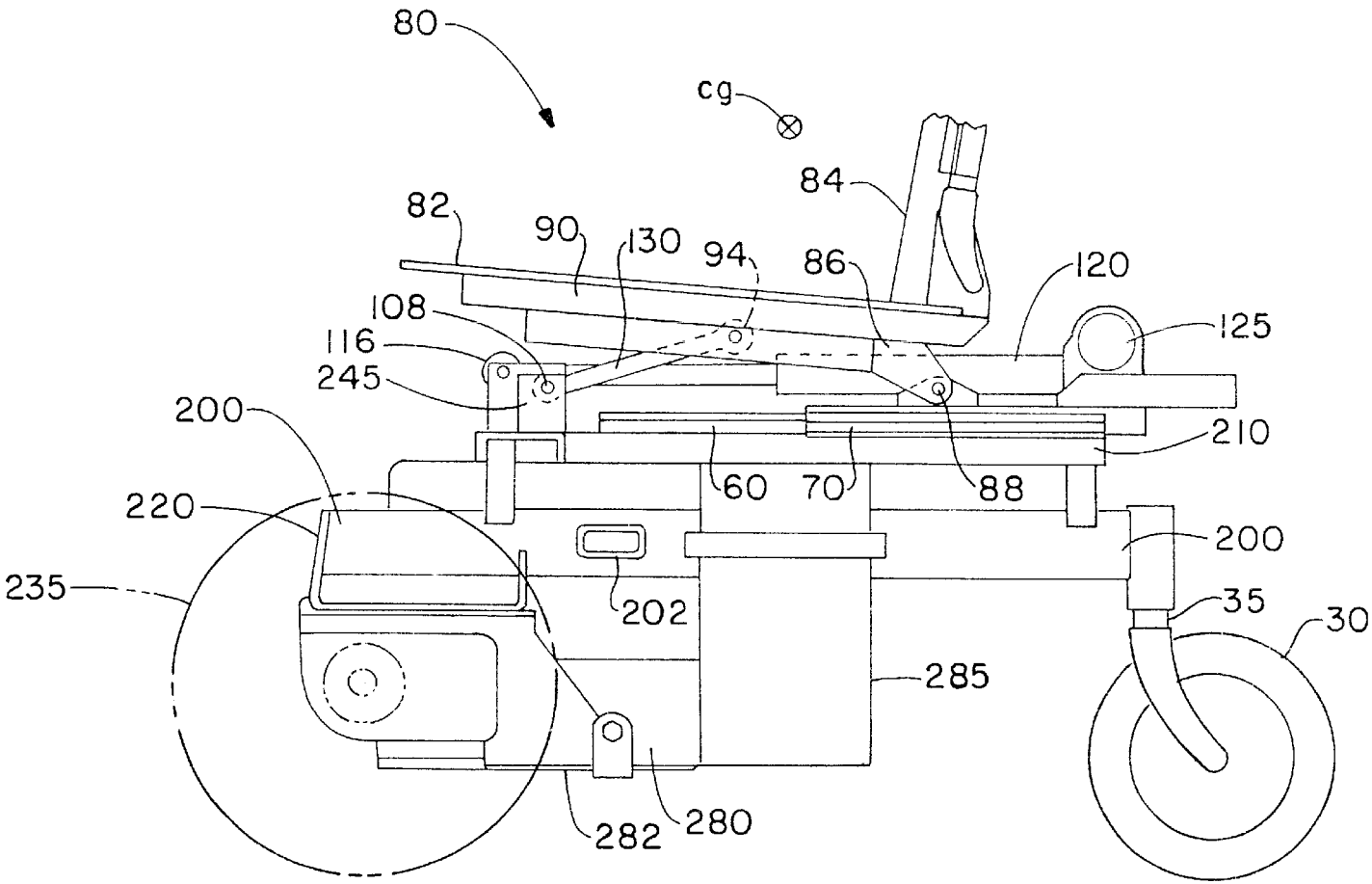
FIG. 10 is a side elevational view of a another embodiment of the present invention.

Referring to FIG. 10, the wheelchair thereof is essentially very similar, if not identical to the frame embodiments of FIGS. 6–9, except for the elimination of anti-tipping front wheel assembly 250. Accordingly, corresponding parts have been labeled with corresponding numbers and the description thereof as set forth above is fully incorporated by reference. Due to the elimination of the anti-tipping wheel, bracket 220 is generally located forward of the position shown in FIGS. 6–9 so that it extends from the front end of frame 200 and rearwardly thereof. Such a chair is often referred to as a front wheel drive wheelchair. As before, gear box bracket 220 can have a plurality of apertures therein so that the drive wheel, gear box and motor, etc., can be located at a range of different longitudinal positions.

Regardless of the embodiment utilized, i.e., FIGS. 1–5, 6–9, or 10, the overall operation of the tilt chair is essentially the same with an individual's center of gravity generally being maintained through the rearward tilting and forward movement of the chair in accordance with the parameters set forth in the Description of the Embodiments of FIGS. 1–5. Of course, as noted above, many other frame structures can be utilized with the constant center of gravity tilt assembly of the present invention. Moreover, the various embodiments of the chair, i.e., FIGS. 1–10, can be operated by an electric motor actuator as shown, or manually wherein the actuator is eliminated and the chair is moved by grasping seat handle 85 and moving it in an appropriate direction. Inasmuch as the center of gravity of a person essentially remains constant, there is substantially no required lifting or upward movement of the seated individual.

While in accordance with the patent statutes the best mode and preferred embodiment have been set forth, the scope of the invention is not limited thereto, but rather by the scope of the attached claims.

What is claimed is:

1. A wheelchair, comprising;

a frame, a tiltable chair operatively connected to said frame by a slidable guide member, said chair having a bracket at a rear portion thereof operatively and pivotally connected to said guide member;

said tiltable chair having a seat and back;

a link arm operatively and pivotally mounted to said frame at one end and pivotally mounted at the other end to a portion of said seat other than at said pivotal rear portion of said chair, and;

an actuator separate and distinct from said link arm, said actuator operatively connected to said frame at one end and at the other end operatively connected to said slidable guide member for sliding a corresponding distance therewith, the length of said link arm being such that when said chair is slid forward upon actuation of said actuator, said link arm raises said chair and tilts said chair backwards.

2. A wheelchair according to claim 1, wherein the frame includes an offset frame said offset frame including lateral side members and a cross frame extending between said lateral side members, said wheelchair further including a rail attached to said lateral members of said offset frame, wherein said guide member slidably engages said rail, wherein one end of said link arm is pivotally connected to said cross frame, and wherein said tiltable chair is operatively and pivotally connected to said offset frame.

3. A wheelchair according to claim 1, wherein the length of said link arm is approximately equal to the length from said link arm seat pivot point to said chair rear bracket pivot point.

4. A wheelchair according to claim 3, including a wheel mounting bracket attached to said frame, and a wheel operatively attached to said bracket.

5. A wheelchair according to claim 4, wherein said wheel mounting bracket has a plurality of apertures so that said wheel can be attached to said wheelchair in a plurality of longitudinal positions.

6. A wheelchair according to claim 1, wherein said wheelchair is a front wheel drive wheelchair, a mid wheel drive wheelchair, or a rear wheel drive wheelchair.

7. A wheelchair according to claim 3, wherein said wheelchair is a front wheel drive wheelchair, a mid wheel drive wheelchair, or a rear wheel drive wheelchair.

8. A wheelchair according to claim 5, wherein said wheelchair is a front wheel drive wheelchair, a mid wheel drive wheelchair, or a rear wheel drive wheelchair.

9. A wheelchair according to claim 1, wherein said chair is capable of being moved by the actuator or manually, and wherein the center of gravity of a person capable of being seated in said chair is substantially maintained when said link arm raises said chair and tilts said chair backwards.

10. A wheelchair, comprising;

a frame, a chair operatively connected to said frame, said chair having a seat portion and a back portion, a link arm operatively and pivotally connected at one end to said frame and operatively and pivotally connected at the other end to said seat, a guide member slidably and operatively connected to said frame, an actuator separate and distinct from said link arm, operatively connected at one end to said slidable guide member for sliding a corresponding distance therewith and operatively connected at the other end to said frame, said chair capable of tilting forwardly or rearwardly upon actuation of said actuator so that said link arm is caused to pivot about said frame and to cause said chair to tilt.

11. A wheelchair according to claim 10, said chair having a rear bracket pivotally connected to said guide member, and wherein the length of said link arm is approximately equal to the length from said link arm seat pivot point to said chair bracket pivot point.

12. A wheelchair according to claim 11, wherein the frame includes an offset frame, said offset frame having a cross frame member connected to lateral side frame members, wherein one end of said link arm is operatively connected to said cross frame and wherein one end of said actuator is operatively connected to said cross frame.

13. A wheelchair according to claim 12, wherein the difference in length between said link arm and the length from said link seat pivot point to said rear bracket pivot point is less than 20 percent.

14. A wheelchair according to claim 13, wherein the difference in length of said link arm and the length of said distance from said link seat pivot point to said rear bracket pivot point is less than 10 percent.

15. A wheelchair according to claim 10, wherein said wheelchair is a front wheel drive wheelchair, mid wheel drive wheelchair, or a rear wheel drive wheelchair.

16. A wheelchair according to claim 13, wherein said wheelchair is a front wheel drive wheelchair, mid wheel drive wheelchair, or a rear wheel drive wheelchair.

17. A front wheel drive wheelchair, comprising;

a wheelchair frame, a tiltable chair operatively connected to said frame by a slidable guide member, said tiltable chair having a bracket at a rear portion thereof operatively and pivotally connected to said guide member;

said tiltable chair having a seat member and a back;

a link arm operatively and pivotally mounted to said frame at one end and operatively and pivotally mounted at the other end to said chair seat member other than at said chair rear bracket, and;

an actuator separate and distinct from said link arm, said actuator operatively connected to said frame at one end and at the other end operatively connected to said slidable guide member for sliding a corresponding distance therewith, the length of said link arm being such that when said chair is slid forward upon actuation of said actuator, said link arm raises said chair and tilts said chair backwards.

18. A front wheel drive wheelchair according to claim 17, including a flange located on said chair frame, one end of said link arm being pivotally connected to said flange, and wherein the length of said link arm is approximately equal to the length from said link arm seat pivot point to said chair rear bracket pivot point.

19. A wheelchair for use by a person having a center of gravity when seated in said wheelchair, comprising;

a wheelchair frame;

a seat frame operatively slidably connected to said wheelchair frame by a slidable guide member;

said seat frame pivotally connected to said slidable guide member;

said seat frame containing a seat and a back;

a control link having one end operatively and pivotally attached to said wheelchair frame and another end pivotally attached to said seat frame; and an actuator separate and distinct from said control link operatively connected to said wheelchair frame at one end and operatively connected to said slidable guide member at the other end other than through said control link for sliding a corresponding distance therewith; said actuator inducing forward sliding movement of said seat frame with respect to said wheelchair frame and through said control link forcing said seat frame to simultaneously pivot and move through a range of angular inclinations and to slide longitudinally with respect to said wheelchair frame so that said center of gravity of a person capable of being seated in said chair is substantially maintained.

20. A wheelchair according to claim 19, wherein the length of said control link is approximately equal to the length from said control link seat frame pivot point to said seat frame guide member pivot point.

21. A wheelchair, comprising;

a main frame;

an offset frame connected to said main frame, said offset frame including lateral members, and a cross frame extending between said lateral members;

a rail attached to said lateral member of said offset frame;

a slideable guide member slidably engaging said rail;

a tiltable chair operatively connected to said offset frame, said chair having a bracket at a rear portion thereof operatively and pivotally connected to said guide member, said tiltable chair having a seat and back; and a link arm pivotally mounted to said cross frame at one end and operatively and pivotally mounted at the other end to a portion of said seat other than at said pivotal rear portion of said chair, and; the length of said link arm being such that when said chair is slid forward, said link arm raises said chair and tilts said chair backwards.

22. The wheelchair according to claim 21, including a flange located on said cross frame, one end of said link arm being pivotally connected to said flange, and wherein the length of said link arm is approximately equal to the length from said link arm seat pivot point to said chair rear bracket pivot point.

23. The wheelchair according to claim 22, including a wheel mounting bracket attached to said main frame, and a wheel operatively attached to said bracket.

24. The wheelchair according to claim 23, wherein said wheel mounting bracket has a plurality of apertures so that said wheel can be attached to said wheelchair in a plurality of longitudinal positions.

25. The wheelchair according to claim 21, wherein said wheelchair is a front wheel drive wheelchair, a mid wheel drive wheelchair, or a rear wheel drive wheelchair.

26. The wheelchair according to claim 22, wherein said wheelchair is a front wheel drive wheelchair, a mid wheel drive wheelchair, or a rear wheel drive wheelchair.

27. The wheelchair according to claim 24, wherein said wheelchair is a front wheel drive wheelchair, a mid wheel drive wheelchair, or a rear wheel drive wheelchair.

28. The wheelchair according to claim 21, wherein said chair is capable of being moved by an actuator or manually, and wherein the center of gravity of a person capable of being seated in said chair is substantially maintained when said link arm raises said chair and tilts said chair backwards.

29. A wheelchair comprising;

a main frame;

an offset frame connected to said main frame, said offset frame having a cross frame member connected to lateral side frame members;

a chair operatively connected to said frame, said chair having a seat portion and a back portion;

a link arm operatively and pivotally connected at one end to said cross frame member and at the other end to said seat;

a guide member slidably and operatively connected to said offset frame; and an actuator connected at one end to said slidable guide member and at the other end to said cross frame member, said chair capable of tilting forwardly or rearwardly upon actuation of said actuator so that said link arm is caused to pivot about said frame and to cause said chair to tilt.

30. The wheelchair according to claim 29, including said chair having a rear bracket pivotally connected to said guide member, and wherein the length of said link arm is approximately equal to the length from said link arm seat pivot point to said chair bracket pivot point.

31. The wheelchair according to claim 30, wherein the difference in length between said link arm and the length from said link seat pivot point to said bracket pivot point is less than 20 percent.

32. The wheelchair according to claim 31, wherein the difference in length of said link arm and the length of said distance from said link seat pivot point to said bracket pivot point is less than 10 percent.

33. The wheelchair according to claim 29, wherein said wheelchair is a front wheel drive wheelchair, mid wheel drive wheelchair, or a rear wheel drive wheelchair.

34. The wheelchair according to claim 31, wherein said wheelchair is a front wheel drive wheelchair, mid wheel drive wheelchair, or a rear wheel drive wheelchair.

* * * * *